US007189915B2

(12) United States Patent
Kobayashi

(10) Patent No.: US 7,189,915 B2
(45) Date of Patent: Mar. 13, 2007

(54) SINGING VOICE SYNTHESIZING METHOD, SINGING VOICE SYNTHESIZING DEVICE, PROGRAM, RECORDING MEDIUM, AND ROBOT

(75) Inventor: Kenichiro Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/547,760

(22) PCT Filed: Mar. 19, 2004

(86) PCT No.: PCT/JP2004/003759

§ 371 (c)(1),
(2), (4) Date: Sep. 2, 2005

(87) PCT Pub. No.: WO2004/084175

PCT Pub. Date: Sep. 30, 2004

(65) Prior Publication Data

US 2006/0185504 A1 Aug. 24, 2006

(30) Foreign Application Priority Data

Mar. 20, 2003 (JP) ..... 2003-079152

(51) Int. Cl.
*G10H 7/00* (2006.01)

(52) U.S. Cl. ..... 84/645; 704/268

(58) Field of Classification Search ..... 84/645; 704/268

See application file for complete search history.

(56) References Cited

U.S. PATENT DOCUMENTS 4,527,274 A * 7/1985 Gaynor ..... 704/267
5,235,124 A * 8/1993 Okamura et al. ..... 434/307 A
5,642,470 A * 6/1997 Yamamoto et al. ..... 704/270
5,998,725 A * 12/1999 Ohta ..... 84/627
6,304,846 B1 * 10/2001 George et al. ..... 704/270
6,424,944 B1 * 7/2002 Hikawa ..... 704/260
2004/0231499 A1 11/2004 Kobayashi
2004/0243413 A1 12/2004 Kobayashi

FOREIGN PATENT DOCUMENTS

| | | |
|---|---|---|
| JP | 6-337690 | 12/1994 |
| JP | 8-185174 | 7/1996 |
| JP | 9-62258 | 3/1997 |
| JP | 10-319955 | 12/1998 |
| JP | 2001-282269 | 10/2001 |
| JP | 2002-132281 | 5/2002 |
| JP | 2002-311952 | 10/2002 |

* cited by examiner

*Primary Examiner*—Jeffrey W Donels
(74) *Attorney, Agent, or Firm*—Oblon, Spivak, McClelland, Maier & Neustadt, P.C.

(57) ABSTRACT

A singing voice synthesizing method for synthesizing the singing voice from performance data is disclosed. The input performance data are analyzed as the musical information of the pitch and the length of sounds and the lyric (S2 and S3). A track as the subject of the lyric is selected from the analyzed musical information (S5). A note the singing voice is allocated to is selected from the track (S6). The length of the note is changed to suit to a song being sung (S7). The voice quality suited to the singing is selected based on e.g. the track name/sequence name (S8) and singing voice data is prepared (S9). The singing voice is generated based on the singing voice data (S10).

28 Claims, 9 Drawing Sheets

| Track | Channel | Time | Type | Pitch | Length | Velocity | Length | Control type |
|---|---|---|---|---|---|---|---|---|
| | | | ⋮ | | | | | |
| 1 | 1 | 5:03:480 | Control | – | – | – | – | Vibrato (depth 64, width 64, delay 50) |
| 1 | 1 | 5:03:480 | Note | G4 | 199 | 100 | あ | |
| 1 | 1 | 5:04:000 | Note | F#4 | 439 | 108 | る | |
| 1 | 1 | 5:04:480 | Note | G4 | 199 | 100 | う | |
| 1 | 1 | 6:01:000 | Note | E4 | 199 | 90 | ひ | |
| 2 | 1 | 4:01:480 | Control | – | – | – | – | Expression (110) |
| 2 | 1 | 4:01:480 | Control | – | – | – | – | Vibrato (depth 64, width 64, delay 50) |
| 2 | 1 | 6:01:480 | Note | G3 | 199 | 100 | あ | |
| 2 | 1 | 6:02:000 | Note | F#3 | 439 | 108 | る | |
| 2 | 1 | 6:02:480 | Note | G3 | 199 | 100 | う | |
| 2 | 1 | 6:03:000 | Note | E3 | 199 | 90 | ひ | |
| | | | ⋮ | | | | | |

FIG.2

| | |
|---|---|
| ¥song¥ | ← Beginning of singing voice data |
| ¥PP,T10673075¥ | ← Pause of 10673075 μ sec |
| ¥tdyna 110 649075¥ | ← Overall velocity of 10673075 μ sec from the beginning |
| ¥fine-100¥ | ← Fine pitch adjustment (same as fine tune of MIDI) |
| ¥vibrato NRPN_dep=64¥ | ← Vibrato |
| ¥vibrato NRPN_del=50¥ | |
| ¥vibrato NRPN_rat=64¥ | |
| ¥dyna 100¥ | ← Strong/weak per sound |
| ¥G4,T288461¥あ | ← Sound with pitch of G4 length of 288461 μ sec, lyric is 'あ' |
| ¥dyna 108¥ | |
| ¥Gb4,T288462¥る | |
| ¥dyna 100¥ | |
| ¥G4,T288461¥う | |
| ¥dyna 90¥ | |
| ¥E4,T219592¥ひ | |
| ¥PP,T1222716¥ | |
| ¥dyna 100¥ | |
| ¥E4,T144231¥も | |
| ¥dyna 98¥ | |
| ¥E4,T144230¥り | |
| ⋮ | |

FIG.3

SINGING VOICE SYNTHESIZING METHOD, SINGING VOICE SYNTHESIZING DEVICE, PROGRAM, RECORDING MEDIUM, AND ROBOT

TECHNICAL FIELD

This invention relates to a method and an apparatus for synthesizing the singing voice from performance data, a program, a recording medium, and a robot apparatus.

The present invention contains subject-matter related to Japanese Patent Application JP-2003-079152, filed in the Japanese Patent Office on Mar. 20, 2003, the entire contents of which being incorporated herein by reference.

BACKGROUND ART

There has so far been known a technique of synthesizing the singing voice from given singing data by e.g. a computer.

MIDI (Musical Instrument Digital Interface) data are representative performance data and accepted as a de-facto standard in the related technical field. Typically, the MIDI data are used to generate the musical sound by controlling a digital sound source, termed a MIDI sound source, for example, a sound source actuated by MIDI data, such as computer sound source or a sound source of an electronic musical instrument. Lyric data may be introduced into a MIDI file, such as SMF (Standard MIDI file), so that the musical staff with the lyric may thereby be formulated automatically.

An attempt in using the MIDI data as representation by parameters (special data expression) of the singing voice or the phonemic segments making up the singing voice has been proposed in, for example the Japanese Laid-Open Patent Publication H-11-95798.

While these related techniques attempt to express the singing voice in the data forms of the MIDI data, such attempt is no more than a control with the sense of controlling a musical instrument.

It was also not possible with the conventional techniques to render the MIDI data, formulated for musical instruments, into songs without correcting the MIDI data.

On the other hand, the voice synthesizing software, for reading aloud an E-mail or a home page, is put for sale from many producers, including the present Assignee. However, the manner of reading is with the usual manner of reading aloud the text.

A mechanical apparatus for performing movements similar to those of a living organism, inclusive of the human being, using electrical or magnetic operations, is called a robot. The use of the robot in Japan dates back to the end of the sixties. Most of the robots used at the time were industrial robots, such as manipulators or transporting robots, aimed to automate the productive operations in a plant or to provide unmanned operations.

Recently, the development of a utility robot, adapted for supporting the human life as a partner for the human being, that is, for supporting human activities in variable aspects of our everyday life, is proceeding. In distinction from the industrial robot, the utility robot is endowed with the ability of learning how to adapt itself on its own to human operators different in personalities or to variable environments in variable aspects of our everyday life. A pet type robot, simulating the bodily mechanism or movements of quadrupeds, such as dogs or cats, or a humanoid robot, designed after the bodily mechanism or movements of the human being, walking on two legs in an erect style, as a model, is being put to practical application.

In distinction from the industrial robot, the utility robot apparatus are able to perform variable movements, centered about entertainment. For this reason, these utility robot apparatus are sometimes called the entertainment robots. Among the robot apparatus of this sort, there are those performing autonomous movements responsive to the information from outside or to inner states.

The artificial intelligence (AI), used for the autonomous robot apparatus, is artificial realization of intellectual functions, such as deduction or judgment. It is further attempted to artificially realize the functions, such as feeling or instinct. Among the expressing means by visual means or natural languages, for expressing the artificial intelligence to outside, there is a means by voice, as an example of the function of the expression employing the natural language.

The conventional synthesis of the singing voice uses data of a special style or, even if it uses MIDI data, the lyric data embedded therein cannot be used efficaciously, or MIDI data, prepared for musical instruments, cannot be sung.

DISCLOSURE OF THE INVENTION

It is an object of the present invention to provide a novel method and apparatus whereby it is possible to overcome the problem inherent in the conventional technique.

It is another object of the present invention to provide a method and an apparatus for synthesizing the singing voice whereby it is possible to synthesize the singing voice by exploiting the performance data, such as MIDI data.

It is a further object of the present invention to provide a method and an apparatus for synthesizing the singing voice, in which the singing voice may be generated on the basis of the lyric information of the MIDI data as prescribed by SMF, a string of sounds as the subject of the singing may automatically be verified to enable music representation of 'slur' or 'marcato' in reproducing the musical information of the string of sounds as the singing voice, and in which, even in case the original MIDI data are not input for the singing voice, the sounds as the subject of the singing may be selected from the performance data and the length of the sounds or the lengths of the rests may be adjusted to convert the notes or the rests into those suited for the singing.

It is yet another object of the present invention to provide a program and a recording medium for having a computer execute the function of synthesizing the singing voice.

A method for synthesizing the singing voice according to the present invention comprises an analyzing step of analyzing performance data as the musical information of the pitch and the length of the sound and the lyric, and a singing voice generating step of generating the singing voice based on the musical information analyzed. The singing voice generating step decides on the type of the singing voice based on the information on the type of the sound included in the musical information analyzed.

An apparatus for synthesizing the singing voice according to the present invention comprises an analyzing means for analyzing performance data as the musical information of the pitch and the length of the sound and the lyric, and a singing voice generating means for generating the singing voice based on the musical information analyzed. The singing voice generating means decides on the type of the singing voice based on the information on the type of the sound included in the musical information analyzed.

With the method and the apparatus for synthesizing the singing voice, according to the present invention, it is possible to analyze performance data to generate the information on the singing voice based on the note information derived from the pitch, length and velocity of the sounds or the lyric obtained from the analyzed performance data to generate the singing voice, while it is possible to decide on the type of the singing voice based on the information pertinent to the type of the sounds contained in the analyzed performance data to permit the song to be sung with the timbre and the voice quality suited to the target musical air.

According to the present invention, the performance data is preferably that of the MIDI file, for example, SMF.

In this case, MIDI data can be exploited with advantage if the type of the singing voice is determined based on the name of the musical instrument or the track name/sequence name included in a track of the performance data of the MIDI file.

In allocating the components of the lyric to a string of sounds of the performance data, it is desirable with e.g. Japanese to allocate a time interval as from a timing of note-on until note-off in the performance data of the MIDI file as a single sound of the singing voice, with the timing of the note-on being a reference for the beginning of each sound of the singing voice. By so doing, the singing voice is uttered at a rate of one sound of the voice per note of the performance data to permit the singing of the string of sounds of the performance data.

The timing or the manner of interlinking of the sounds of the singing voice is desirably adjusted in dependence upon the temporal relationship of neighboring notes in the string of sounds of the performance data. For example, if there is a note-on of the second note, as a note superposed on the first note, temporally ahead of a note-off of the first note, the uttering of the first sound of the singing voice is stopped short, even before the note-off of the first note, and the second sound is enunciated at a timing of the note-on of the second sound. If there is no superposition between the first and second notes, the sound volume of the first sound is attenuated to render the break point thereof from the second sound clear. If there is superposition between the first and second notes, the first and second sounds are pieced together, without attenuating the sound volume of the first sound. In the former case, the song is sung with 'marcato' in which the sounds of the song are sung with breaks between the neighboring sounds. In the second case, the song is sung smoothly with 'slur'. If there is no superposition between the first and second notes but there is only a time interval of sound interruption therebetween shorter than a pre-specified time interval, the timing of the end of the first sound is shifted to the timing of the start of the second sound to piece the first and second sounds together at this timing.

There are occasions where performance data of chords are included in performance data. For example, in the case of MIDI data, there are occasions where the performance data of chords are recorded in a given track or channel. The present invention takes account of which string of the sounds is to be a subject of a lyric in case there are present such performance data of chords. For example, if there are plural notes having the same note-on timing, in the performance data of the MIDI file, the note having the highest pitch is selected as the sound of the subject of singing. This assures facilitated singing of the so-called soprano part. Alternatively, should there be plural notes having the same note-on timing in the above performance data of the MIDI file, the note having the lowest pitch is selected as the sound of the subject of singing. This enables the so-called base part to be sung. Should there be plural notes having the same note-on timing in the performance data of the MIDI file, the note having the largest specified sound volume is selected as the sound as the target of singing. This enables the main melody or the theme to be sung. Still alternatively, should there be plural notes having the same note-on timing in the above performance data of the MIDI file, the respective notes are treated as separate voice parts and the same lyric is imparted to the respective voice parts to generate the singing voices of different sound pitch values. This enables a chorus by these voice parts.

There are also occasions where data parts intended for reproducing the musical sound of percussions, such as xylophone, or modified sounds of short length, are included in input performed data. In such case, the length of the sounds of the singing voice is desirably adjusted for singing. To this end, if, in the performance data of the above MIDI file, the time as from the note-on until note-off is shorter than a prescribed value, the note is not to be the subject for singing. Or, the time as from the note-on until note-off in the performance data of the above MIDI file is expanded a preset ratio to generate the singing voice. Alternatively, a preset time is added to the time as from the note-on until note-off to generate the singing voice. The preset data of the addition or ratio for varying the time as from note-on until note-off is desirably provided in a form consistent with the name of the musical instrument and/or desirably may be settable by an operator.

Preferably, the type of the singing voice enunciated may be set by the singing voice from one musical instrument to another.

If the designation of the musical instrument has been changed by a patch in the performance data of the MIDI file, the singing voice setting step desirably changes the type of the singing voice, partway during singing, even in the same track.

The program according to the present invention allows a computer to execute the singing voice synthesizing function according to the present invention. The program according to the present invention may be read by a computer having the program recorded therein.

The robot apparatus according to the present invention is an autonomous robot apparatus for performing movements based on the input information supplied, and comprises analyzing means for analyzing performance data as the musical information of the pitch and the length of the sound and the lyric, and singing voice generating means for generating the singing voice based on the musical information analyzed. The singing voice generating means decides on the type of the singing voice based on the information on the type of the sound included in the musical information analyzed. This further improves the properties of the robot as an entertainment robot.

BRIEF DESCRIPTION OF THE DRAWINGS

FIG. 2 shows an example of the music note information of the results of analysis.

FIG. 3 shows an example of the signing voice information.

BEST MODE FOR CARRYING OUT THE INVENTION

Figure 1:
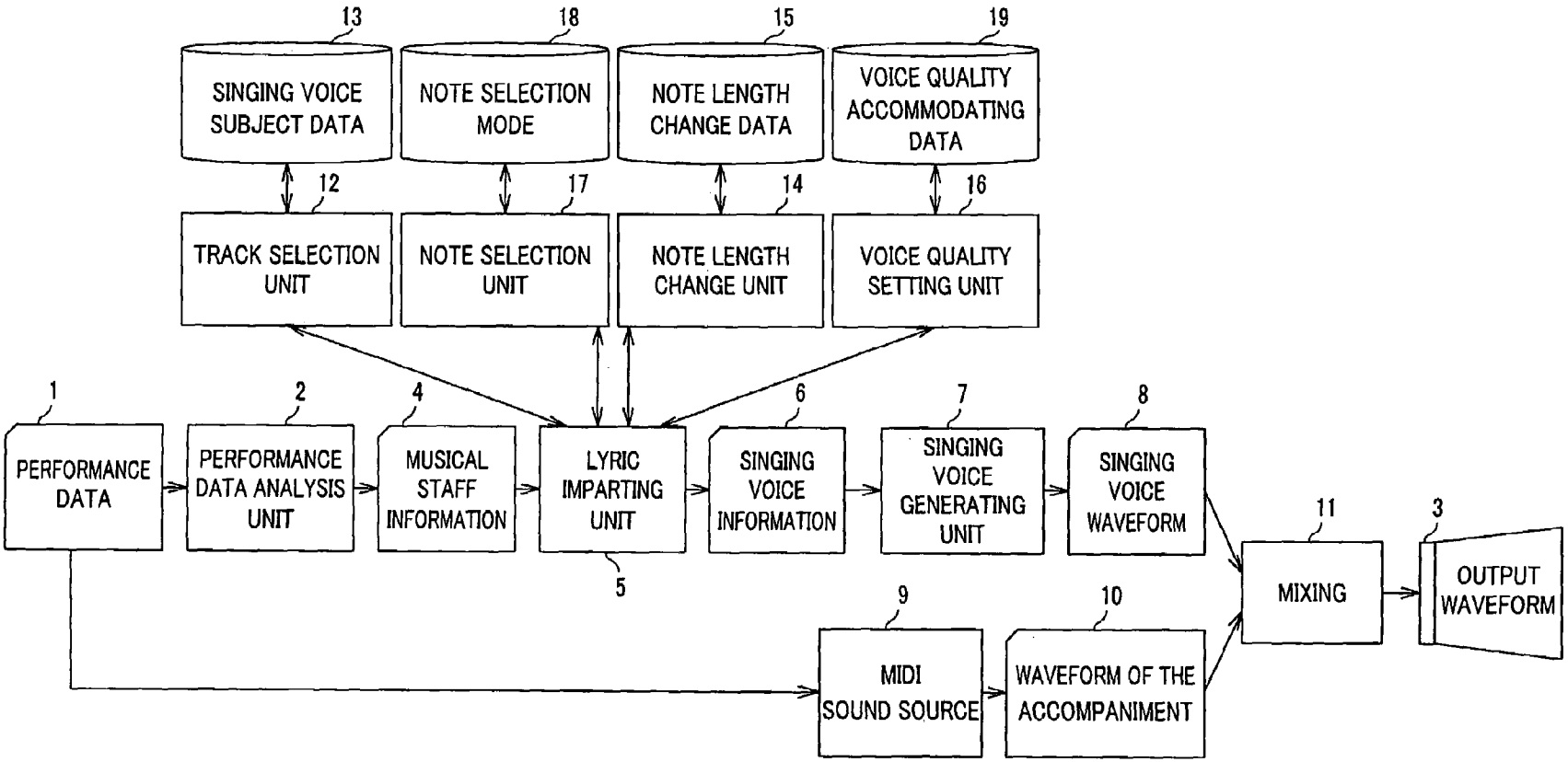
FIG. 1 is a block diagram showing a system of a singing voice synthesizing apparatus according to the present invention.

Referring to the drawings, preferred embodiments of the present invention will be explained in detail.

FIG. 1 shows the schematic system configuration of a singing voice synthesizing apparatus according to the present invention. It is noted that the present singing voice synthesizing apparatus is presupposed to be used for e.g. a robot apparatus which at least includes a feeling model, a speech synthesizing means and an utterance means. However, this is not to be interpreted in a limiting fashion and, of course, the present invention may, be applied to a variety of robot apparatus and to a variety of computer AI (artificial intelligence) other than the robot.

In FIG. 1, a performance data analysis unit 2, analyzing performance data 1, represented by MIDI data, analyzes the performance data entered to convert the data into musical staff information 4 indicating the pitch, length or velocity of the sound of a track or a channel included in the performance data.

FIG. 2 shows an example of performance data (MIDI data) converted into music staff information. Referring to FIG. 2, an event is written from one track to the next and from one channel to the next. The event includes a note event and a control event. The note event has the information on the time of generation (column 'time' in FIG. 2 ), pitch, length and intensity (velocity). Hence, a string of musical notes or a string of sounds is defined by a sequence of the note events. The control event includes data showing the time of generation, control type data, such as vibrato, expression of performance dynamics and control contents. In the case of vibrato, for example, the control contents include items of 'depth' indicating the magnitude of sound pulsations, 'length' indicating the period of sound pulsations, and 'delay' indicating the start timing of the sound pulsations (delay time as from the utterance timing). The control event for a specified track or channel is applied to the representation of the musical sound of the string of sound notes of the track or channel in question, except if there occurs a new control event (control change) for the control type in question. Moreover, in the performance data of the MIDI file, the lyric can be entered on the track basis. In FIG. 2, 'あるう日'('one day', uttered as 'a-ru-u-hi'), indicated in an upper part, is a part of the lyric, entered in a track 1, whilst 'あるう日', indicated in a lower part, is a part of the lyric, entered in a track 2. That is, in the example of FIG. 2, the lyric has been embedded in the music information (musical staff information) analyzed.

In FIG. 2, the time is indicated by "bar: beat: number of ticks", the length is indicated by "number of ticks", the velocity is indicated by a number '0 to 127' and the pitch is indicated by 'A4' for 440 Hz. On the other hand, the depth, length and the delay of the vibrato are represented by the numbers of '0–64–127', respectively.

Reverting to FIG. 1, the musical staff information 4, as converted, is delivered to a lyric imparting unit 5. The lyric imparting unit 5 generates the singing voice information 6, composed of the lyric for a sound, matched to a sound note, along with the information on the length, pitch, velocity and expression of the sound, in accordance with the musical staff information 4.

FIG. 3 shows examples of the singing voice information 6. In FIG. 3, '¥song¥' is a tag indicating the beginning of the lyric information. A tag '¥PP, T10673075¥' indicates the pause of 10673075 μsec, a tag '¥tdyna 110 649075¥' indicates the overall velocity for 10673075 μsec from the leading end, a tag '¥fine-100¥' indicates fine pitch adjustment, corresponding to fine tune of MIDI, and tags '¥vibrato NRPN_dep=64¥', '¥vibrato NRPN_del=64¥' and '¥vibrato NRPN_rat=64¥' denote the depth, delay and width of the vibrato, respectively. A tag '¥dyna 100¥' denotes the relative velocity from sound to sound, and a tag 'yG4, T288461¥あ' denotes a lyric element 'あ'(uttered as 'a') having a pitch of G4 and a length of 288461 μsec. The singing voice information of FIG. 3 has been obtained from the musical staff information (results of analysis of MIDI data) shown in FIG. 2. The lyric information of FIG. 3 is obtained from the music staff information shown in FIG. 2 (results of analysis of MIDI data). As may be seen from comparison of FIGS. 2 and 3, the performance data for controlling the musical instrument, such as the musical staff information, is fully used for generating the singing voice information. For example, as for a component element 'あ'in the lyric part 'あるう日', the time of generation, length, pitch or the velocity thereof, included in the control information or in the note event information in the musical staff information (see FIG. 2 ), is directly utilized in connection with the other singing attributes than 'あ', for example, the time of generation, length, pitch or the velocity of the sound 'あ', the next note event information in the same track or channel in the musical staff information is also directly used for the next lyric element 'る'(uttered as 'u'), and so on.

Reverting to FIG. 1, the singing voice information 6 is delivered to a singing voice generating unit 7, in which singing voice generating unit 7 a singing waveform 8 is generated based on the singing voice information 6. The singing voice generating unit 7, generating a singing voice waveform 8 from the singing voice information 6, is configured as shown for example in FIG. 4.

Figure 4:
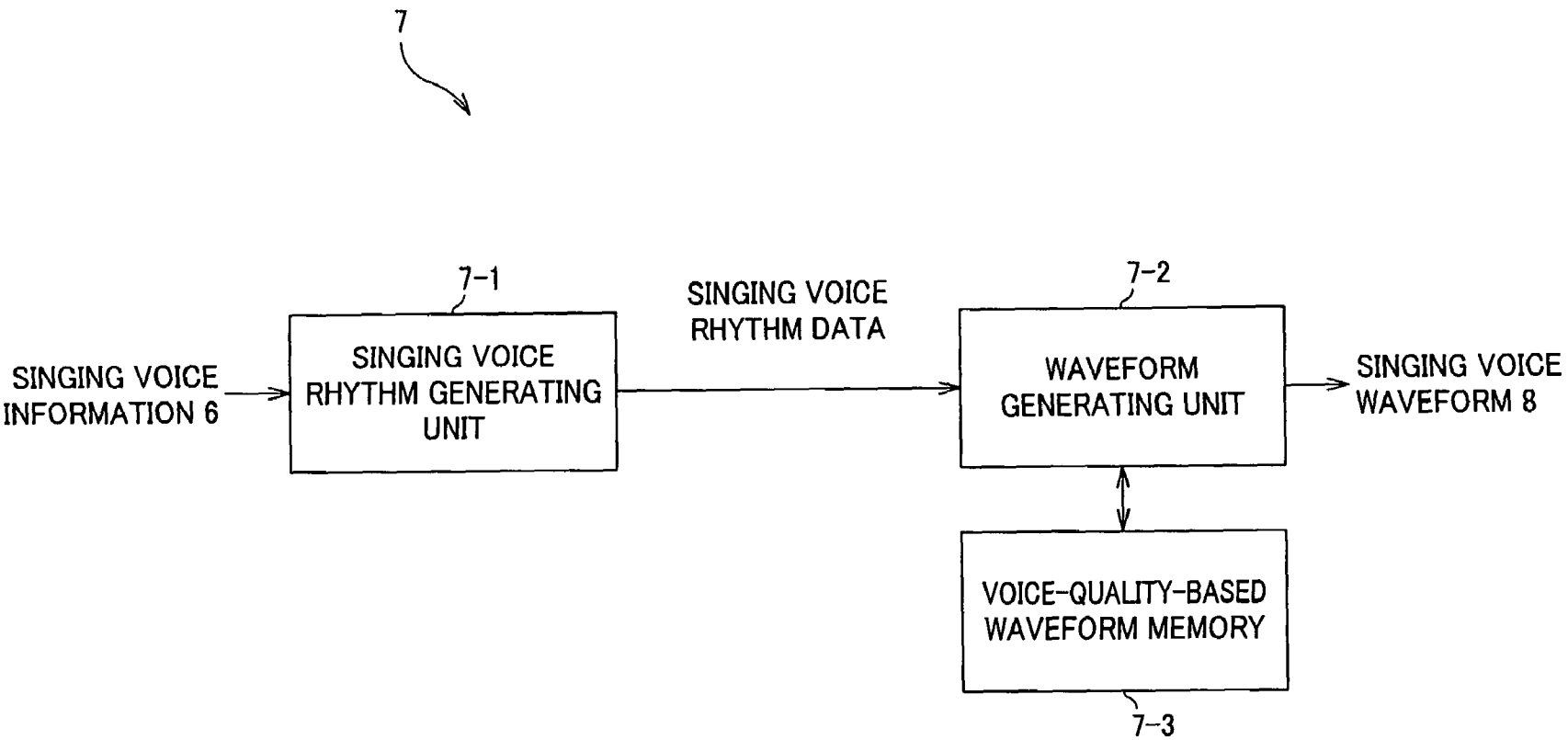
FIG. 4 is a block diagram showing the structure of a singing voice generating unit.

In FIG. 4, a singing voice rhythm generating unit 7-1 converts the singing voice information 6 into the singing voice rhythm data. A waveform generating unit 7-2 converts the singing voice rhythm data into the singing voice waveform 8 via a voice-quality-based waveform memory 7-3.

As a specified example, the case of expanding the lyric element 'ら' (uttered as 'ra') a preset time length will now be explained. The singing voice rhythm data in case vibrato is not applied may be represented as indicated in the following Table 1:

TABLE 1

| [LABEL] | | [PITCH] | | [VOLUME] | |
|---|---|---|---|---|---|
| 0 | ra | 0 | 50 | 0 | 66 |
| 1000 | aa | | | 39600 | 57 |
| 39600 | aa | | | 40100 | 48 |
| 40100 | aa | | | 40600 | 39 |
| 40600 | aa | | | 41100 | 30 |
| 41100 | aa | | | 41600 | 21 |
| 41600 | aa | | | 42100 | 12 |

TABLE 1-continued

| [LABEL] | | [PITCH] | [VOLUME] | |
|---|---|---|---|---|
| 42100 | aa | | 42600 | 3 |
| 42600 | aa | | | |
| 43100 | a. | | | |

In the above table, [LABEL] represents the time length of the respective sounds (phoneme elements). That is, the sound (phoneme element) 'ra' has a time length of 1000 samples from sample 0 to sample 1000, and the initial sound 'aa', next following the sound 'ra', has a time length of 38600 samples from sample 1000 to sample 39600. The 'PITCH' represents the pitch period by a point pitch. That is, the pitch period at a sample point 0 is 56 samples. Here, the pitch of 'ら' is not changed, so that the pitch period of 56 samples is applied across the totality of the samples. On the other hand, 'VOLUME' represents the relative sound volume at each of the respective sample points. That is, with the default value of 100%, the sound volume at the 0 sample point is 66%, while that at the 39600 sample point is 57%. The sound volume at the 40100 sample point is 48%, the sound volume is 3% at the 42600 sample point, and so on. This achieves the attenuation of the sound of 'ら' with lapse of time.

On the other hand, if vibrato is applied, the singing voice rhythm data, shown in the following Table 2, are formulated:

TABLE 2

| [LABEL] | | [PITCH] | | [VOLUME | |
|---|---|---|---|---|---|
| 0 | ra | 0 | 50 | 0 | 66 |
| 1000 | aa | 1000 | 50 | 39600 | 57 |
| 11000 | aa | 2000 | 53 | 40100 | 48 |
| 21000 | aa | 4009 | 47 | 40600 | 39 |
| 31000 | aa | 6009 | 53 | 41100 | 30 |
| 39600 | aa | 8010 | 47 | 41600 | 21 |
| 40100 | aa | 10010 | 53 | 42100 | 12 |
| 40600 | aa | 12011 | 47 | 42600 | 3 |
| 41100 | aa | 14011 | 53 | | |
| 41600 | aa | 16022 | 47 | | |
| 42100 | aa | 18022 | 53 | | |
| 42600 | aa | 20031 | 47 | | |
| 43100 | a. | 22031 | 53 | | |
| | | 24042 | 47 | | |
| | | 26042 | 53 | | |
| | | 28045 | 47 | | |
| | | 30045 | 53 | | |
| | | 32051 | 47 | | |
| | | 34051 | 53 | | |
| | | 36062 | 47 | | |
| | | 38062 | 53 | | |
| | | 40074 | 47 | | |
| | | 42074 | 53 | | |
| | | 43010 | 50 | | |

As indicated in the column 'PITCH' of the above Table, the pitch period at a 0 sample point and that at a 1000 sample point are both 50 samples and are equal to each other. During this time interval, there is no change in the pitch of the speech. As from this time, the pitch period is swung up and down, in a range of 50±3, at a period (width) of approximately 4000 samples, as exemplified by the pitch periods of 53 samples at 2000 sample points, 47 samples at 4009 sample point and 53 samples at 6009 sample point. In this manner, the vibrato, which is the pulsations of the pitch of the speech, is achieved. The data of the column 'PITCH' is generated based on the information on the corresponding singing voice element in the singing voice information 6, such as 'ら', in particular the note number, such as A4, or the vibrato control data, such as tag '¥vibrato NRPN_dep=64¥', 'vibrato NRPN_del=50¥' or '¥vibrato NRPN_rat=64¥'.

Based on the above singing voice phoneme data, the waveform generating unit 7-2 reads out samples of the voice quality of interest from the voice-quality-based waveform memory 7-3 to generate the singing voice waveform 8. The voice-quality-based waveform memory has stored therein phoneme segment data from one voice quality to another. The waveform generating unit 7-2 retrieves, based on a phoneme element sequence, pitch period and the sound volume, indicated in the singing voice rhythm data, the phoneme segment data which are as approximate as possible to the above phoneme element sequence, pitch period and the sound volume, as the waveform generating unit refers to the voice-quality-based waveform memory 7-3. The so retrieved data are sliced out and arrayed to generate the speech waveform data. That is, phoneme element data are stored in the voice-quality-based waveform memory 7-3, from one voice quality to another, in the form of, for example, CV (consonant-vowel), VCV or CVC. The waveform generating unit 7-2 concatenates phoneme element data, as needed, based on the singing voice phoneme data, and appends e.g. the pause, accent type, or the intonations, as appropriate, to the resulting concatenated data, to generate the singing voice waveform 8. It is noted that the singing voice generating unit for generating the singing voice waveform 8 from the singing voice information 6 is not limited to the singing voice generating unit 7 and any other suitable singing voice generating unit may be used.

Reverting to FIG. 1, the performance data 1 is delivered to a MIDI sound source 9, which MIDI sound source 9 then generates the musical sound based on the performance data. The musical sound generated is a waveform of the accompaniment 10.

The singing voice waveform 8 and the waveform of the accompaniment 10 are delivered to a mixing unit 11 adapted for synchronizing and mixing the two waveforms with each other.

The mixing unit 11 synchronizes the singing voice waveform 8 with the waveform of the accompaniment 10 and superposes the two waveforms together to generate and reproduce the so superposed waveforms. Thus, music is reproduced by the singing voice, with the accompaniment, attendant thereon, based on the performance data 1.

The lyric imparting unit 5 selects the track, as a subject of the singing voice, based on any of the track name/sequence name of the music information, stated in the musical staff information 4, or the name of the musical instrument, by a track selector 12. For example, if the type of the sound or the voice, such as 'soprano', is specified as a track name, the track is directly determined to be the track of the singing voice. In the case of a musical instrument, such as 'violin', a track specified by an operator is the subject of the singing voice. However, this is not the case if there is no designation by the operator. The information as to whether a given track may be a subject of the singing voice is contained in a singing voice subject data 13, the contents of which may be changed by an operator.

On the other hand, which voice quality should be applied to the track previously selected can be set by a voice quality setting unit 16. In designating the voice quality, the type of the voice to be enunciated can be set from one track to another and from one musical instrument to another. The information including the setting of the correlation between the name of the musical instrument and the voice quality is retained as voice quality accommodating data 19 and reference may be made to this voice quality accommodating data to select the voice quality associated with e.g. the names of the musical instruments. For example, the voice qualities 'soprano', 'alto1', 'alto2', 'tenor1' and 'bass1', as the voice qualities of the singing voice, may be associated with the names of the musical instruments 'flute', 'clarinet', 'alto-sax', 'tenor sax' and 'bassoon', respectively. Turning to the priority sequence of the voice quality designation, (a) if the voice quality has been specified by an operator, the voice quality so specified is applied and (b) if letters/characters specifying the voice quality are contained in the track name/sequence name, the voice quality of the relevant string of the letters/characters is applied. In addition, (c) in the case of a musical instrument the name of which is contained in the voice quality accommodating data 19 associated with the names of the musical instruments, the corresponding voice quality stated in the voice quality accommodating data 19 is applied and (d) if the above conditions are irrelevant, the default voice quality is applied. This default voice quality may or may not be applied, depending on the mode. With the mode for which the default voice quality is not applied, the sound of the musical instrument is reproduced from the MIDI.

On the other hand, if the designation of the musical instrument has been changed by patching, as control data, in a given MIDI track, the voice quality of the singing voice can be changed partway, even in the same track, in accordance with the voice quality accommodating data 19.

The lyric imparting unit 5 generates the singing voice information 6 based on the musical staff information 4. In this case, the note-on timing in the MIDI data is used as reference for the beginning of each singing voice sound of a song. The sound continuing as from this timing until note-off is deemed to be one sound.

Figure 5:
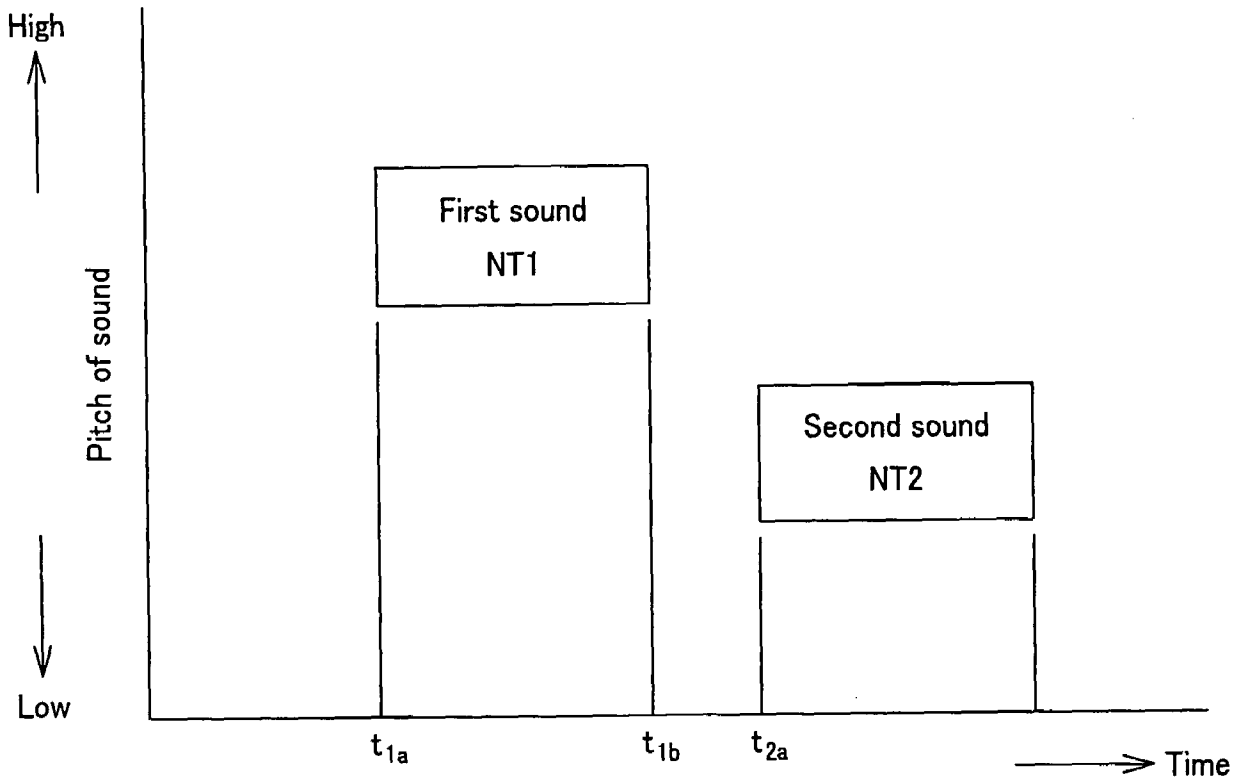
FIG. 5 schematically shows the first and second sounds in the performance data used for explanation of adjustment of the note length in the singing voice sound.

FIG. 5 shows the relationship between a first note or a first sound NT1 and a second note or a second sound NT2. In FIG. 5, the note-on timing of the first sound NT1 is indicated as t1*a*, the note-off timing of the first sound NT1 is indicated as t1*b* and the note-on timing of the second sound NT2 is indicated as t2*a*. As described above, the lyric imparting unit 5 uses the note-on timing in the MIDI data as the beginning reference of each singing voice sound in a song (t1*a* is used as the beginning reference of the first sound NT1), and allocates the sound continuing until its note-off as one singing voice sound. This is the basis of the imparting of the lyric. Thus, the lyric is sung, from one sound to the next, in keeping with the length and with the note-on timing of each musical note in the sound string of the MIDI data.

However, if there is the note-on of the second sound TN2, as a superposed sound, between the note-on and the note-off of the first sound NT1 (t1*a*~t1*b*), that is, if t1*b*>t2*a*, the sound note length changing unit 14 changes the note-off timing of the singing voice sound, such that the singing voice sound is discontinued even before the note-off of the first note-off, and the next singing voice sound is uttered at the note-on timing t2*a* of the second sound TN2.

If there is no superposition between the first sound NT1 and the second sound NT2 in the MIDI data (t1*a*<t2*a*), the lyric imparting unit 5 attenuates the sound volume for the first sound of the singing voice to render the break point from the second sound of the singing voice clear to express 'marcato'. If conversely there is superposition between the first and second sounds, the lyric imparting unit does not attenuate the sound volume and pieces the first and second sounds together to express 'slur' in a musical air.

If there is no superposition between the first sound NT1 and the second sound NT2 in the MIDI data, but there exists only a sound interruption shorter than a preset time stored in a sound note length changing data 15, the sound note length changing unit 14 shifts the note-off timing of the first singing voice sound to the note-on timing of the second singing voice sound to piece the first and second singing voice sounds together.

If there are plural musical notes or sounds in the MIDI data, the note-on timings of which are the same (for example, t1*a*=t2*a*), the lyric imparting unit 5 causes a sound note selecting unit 17 to select a sound selected from the group consisting of the sound having the highest pitch, the sound having the lowest pitch and the sound having the largest sound volume, as a subject of the singing voice, in accordance with a sound note selecting mode 18.

In the sound note selecting mode 18, which of the sound having the highest pitch, the sound having the lowest pitch, the sound having a large sound volume and an independent sound is to be selected may be set, depending on the voice type.

If, in the performance data of a MIDI file, there are plural sound notes having the same note-on timings, and these sound notes are set as independent sounds, in the sound note selecting mode 18, the lyric imparting part 5 handles these sounds as distinct voice parts and imparts the same lyric to these sounds to generate the singing voice of the distinct sound pitches.

If the time length as from the note-on until note-off is shorter than a prescribed value as set in the sound note length changing data 15 via a sound note length changing unit 14, the lyric imparting unit 5 does not use the sound as the subject of the singing.

The sound note length changing unit 14 expands the time as from note-on until note-off, by a ratio pre-set in the sound note length changing data 15, or by addition of prescribed time. These sound note length changing data 15 are held in a form matched to the name of the musical instrument in the musical staff information and may be set by an operator.

The case in which the lyric is included in the performance data in connection with the lyric information has been explained in the foregoing. The present invention is, however, not limited to this configuration. If the lyric is not included in the performance data, an optional lyric, for example, 'ら'or 'ぼん'(uttered as 'bon') may be generated automatically or entered by an operator and performance data as the subject of the lyric (track or channel) may be selected by a track selector or by the lyric imparting unit 5 for lyric allocation.

Figure 6:
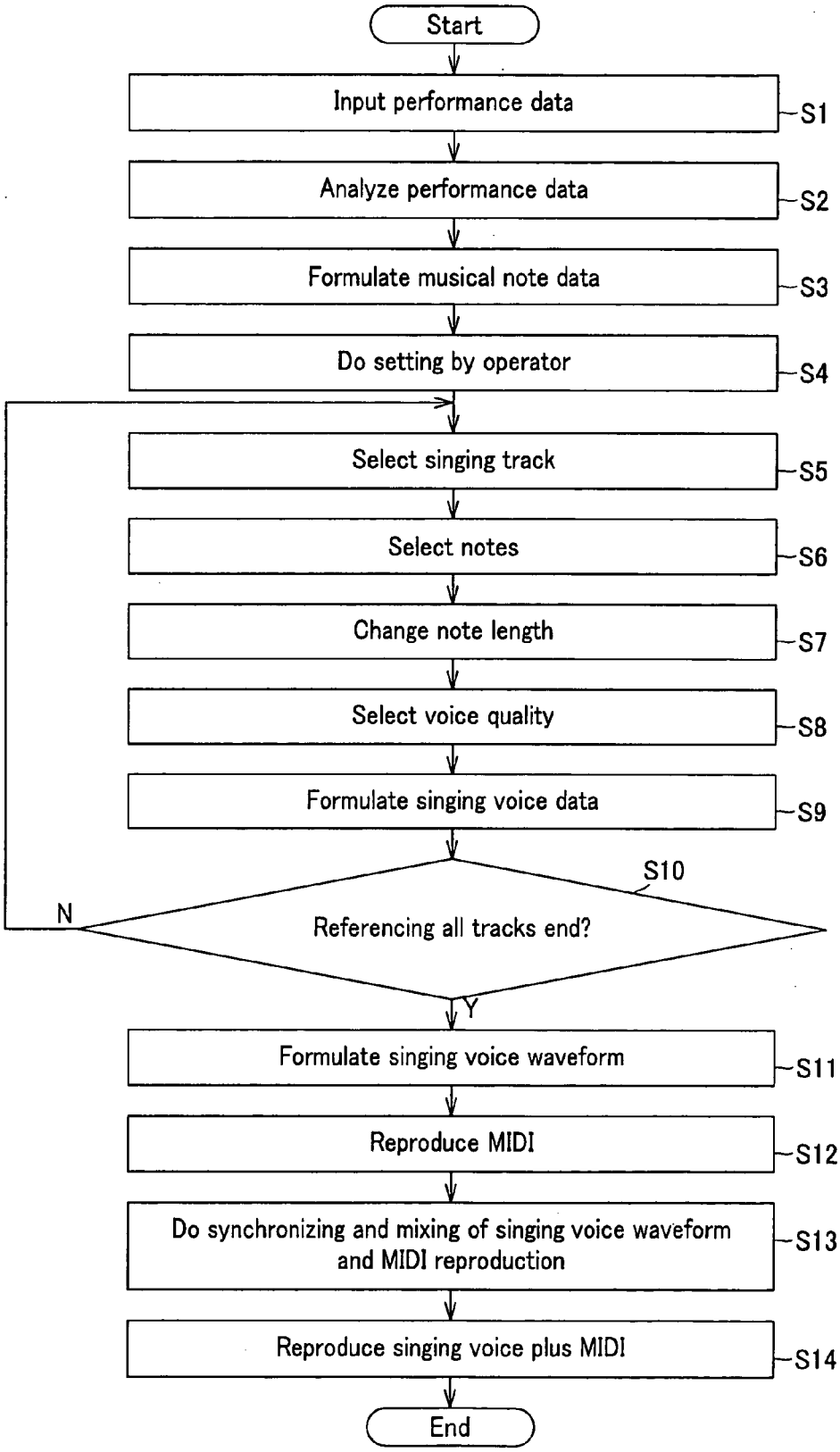
FIG. 6 is a flowchart for illustrating the operation of the singing voice synthesis according to the present invention.

FIG. 6 depicts the flowchart for illustrating the overall operation of the singing voice synthesizing apparatus.

First, the performance data 1 of the MIDI file is entered (step S1). The performance data 1 then is analyzed, and the musical staff data 4 then is entered (steps S2 and S3). An enquiry then is made to an operator, who then carries out the processing for setting e.g. data as a subject of the singing voice, a mode for selecting the sound notes, data for changing the sound note length or data for coping with the voice quality (step S4). Insofar as the operator has not carried out the setting, default setting is applied in the subsequent processing.

The next following steps S5 to S10 represent a loop for generating the singing voice information. First, the track, as a subject of the lyric, is selected by a track selection unit 12 (step S5). The sound notes, to be allocated to the singing voice sounds in accordance with the sound note selecting mode, is determined by the sound note selecting unit 17 from the track as the subject of the lyric (step S6). The length of the sound notes, allocated to the singing voice sounds, such as timing of utterance or the time length, is changed as necessary by the note length changing unit 14 in accordance with the above-defined conditions (step S7). The singing voice information 6 is then prepared, based on the data obtained in the steps S5 to S8 by the lyric imparting unit 5 (step S9).

It is then checked whether or not the referencing to the totality of tracks has been finished (step S10). If the referencing has not been finished, processing reverts to the step S5 and, if the referencing has been finished, the singing voice information 6 is delivered to the singing voice generating unit 7 to formulate the waveform of the singing voice (step S11).

The MIDI then is reproduced by the MIDI sound source 9 to formulate the waveform of the accompaniment 10 (step S12).

By the processing, carried out so far, the singing voice waveform 8 and the waveform of the accompaniment 10 are formulated.

The mixing unit 11 superposes the singing voice waveform 8 and the waveform of the accompaniment 10 together, as the two waveforms are synchronized with each other, to form an output waveform 3, which is reproduced (steps S13 and S14). This output waveform 3 is output, as acoustic signals, via a sound system, not shown.

The singing voice synthesizing function, described above, is comprised in e.g. a robot apparatus.

The robot apparatus of the type walking on two legs, shown as an embodiment of the present invention, is a utility robot supporting human activities in various aspects of our everyday life, such as in our living environment, and is able to act responsive to an inner state, such as anger, sadness, pleasure or happiness. At the same time, it is an entertainment robot capable of expressing basic behaviors of the human being.

Figure 7:
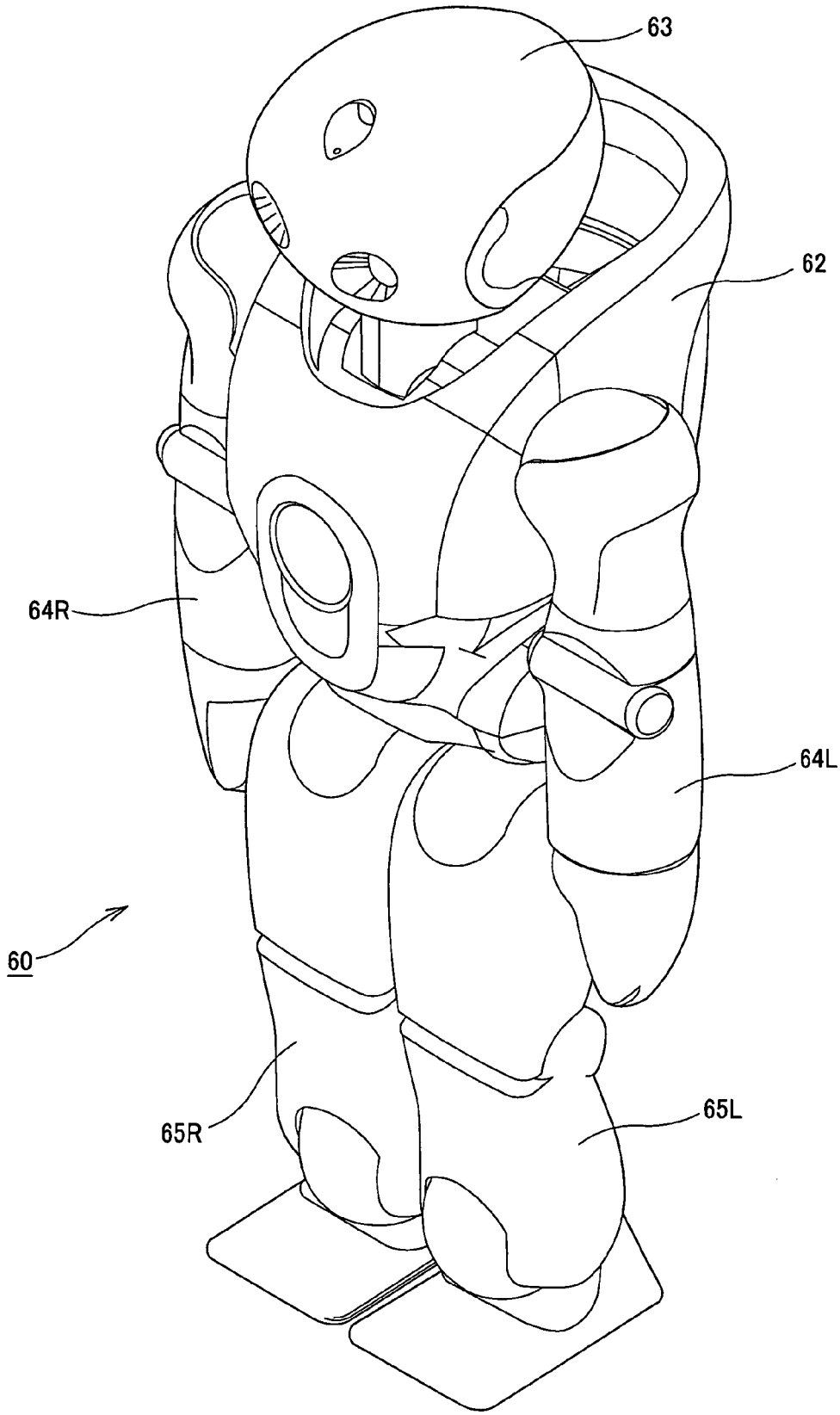
FIG. 7 is a perspective view showing the appearance of a robot apparatus according to the present invention.

Referring to FIG. 7, the robot apparatus 60 is formed by a body trunk unit 62, to preset positions of which there are connected a head unit 63, left and right arm units 64R/L and left and right leg units 65R/L, where R and L denote suffixes indicating right and left, respectively, hereinafter the same.

Figure 8:
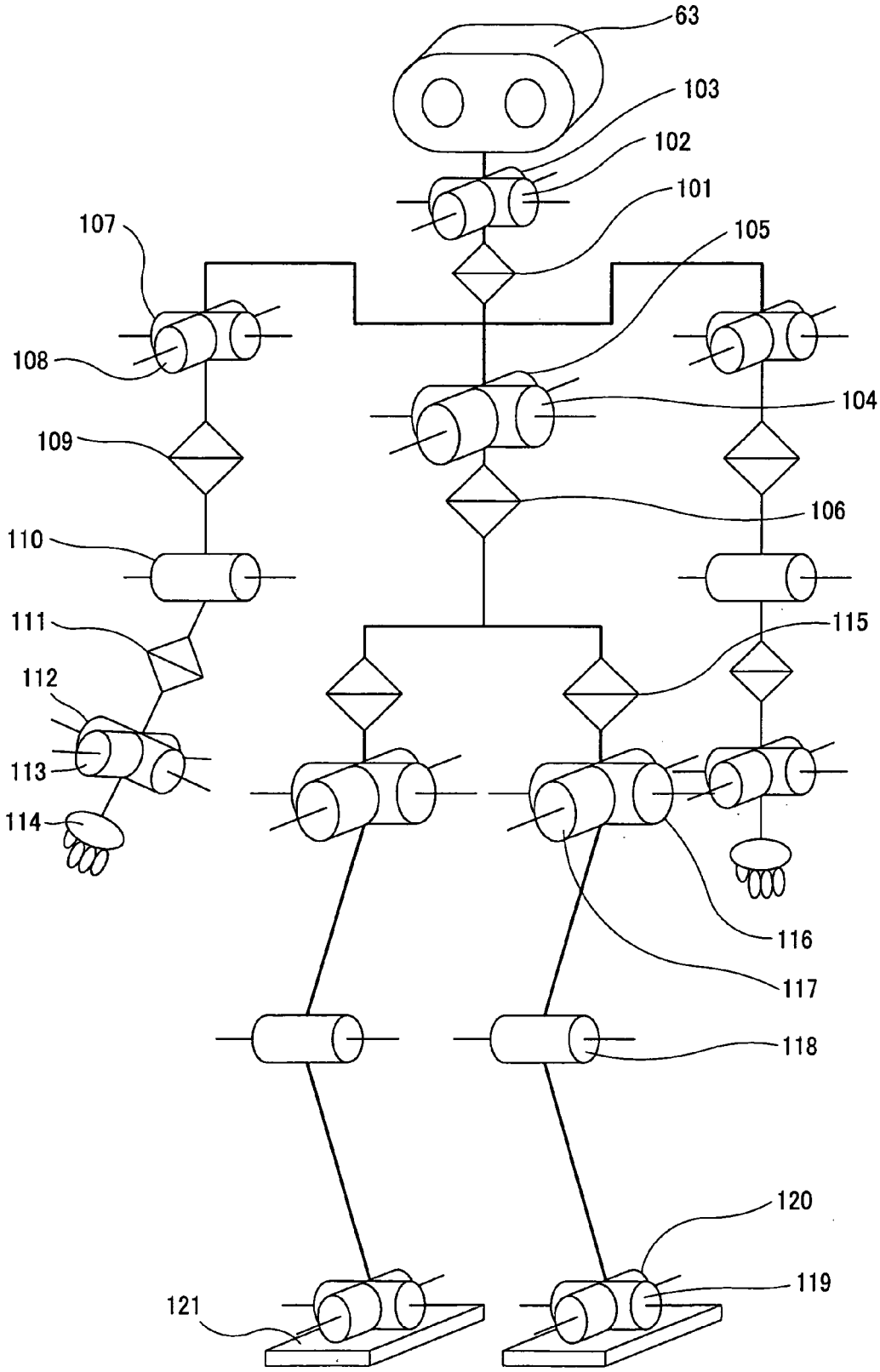
FIG. 8 schematically shows a model of the structure of the degree of freedom of a robot apparatus.

The structure of the degrees of freedom of the joints, provided for the robot apparatus 60, is schematically shown in FIG. 8. The neck joint, supporting the head unit 63, includes three degrees of freedom, namely a neck joint yaw axis 101, a neck joint pitch axis 102 and a neck joint roll axis 103.

The arm units 64R/L, making up upper limbs, are formed by a shoulder joint pitch axis 107, a shoulder joint roll axis 108, an upper arm yaw axis 109, an elbow joint pitch axis 110, a forearm yaw axis 111, a wrist joint pitch axis 112, a wrist joint roll axis 113 and a hand unit 114. The hand unit 114 is, in actuality, a multi-joint multi-freedom-degree structure including plural fingers. However, since the movements of the hand unit 114 contribute to or otherwise affect posture control or walking control for the robot apparatus 60, the hand unit is assumed in the present description to have a zero degree of freedom. Consequently, the arm units are each provided with seven degrees of freedom.

The body trunk unit 62 also has three degrees of freedom, namely a body trunk pitch axis 104, a body trunk roll axis 105 and a body trunk yaw axis 106.

Each of leg units 65 R/L, forming the lower limbs, is made up by a hip joint yaw axis 115, a hip joint pitch axis 116, a hip joint roll axis 117, a knee joint pitch axis 118, an ankle joint pitch axis 119, an ankle joint roll axis 120, and a leg unit 121. In the present description, the point of intersection of the hip joint pitch axis 116 and the hip joint roll axis 117 prescribes the hip joint position of the robot apparatus 60. Although the leg unit 121 of the human being is, in actuality, a structure including the foot sole having multiple joints and multiple degrees of freedom, the foot sole of the robot apparatus is assumed to be of the zero degree of freedom. Consequently, each leg has six degrees of freedom.

In sum, the robot apparatus 60 in its entirety has a sum total of $3+7\times2+3+6\times2=32$ degrees of freedom. It is noted however that the number of the degrees of freedom of the robot apparatus for entertainment is not limited to 32, such that the number of the degrees of freedom, that is, the number of joints, may be suitably increased or decreased depending on the constraint conditions in designing or in manufacture or on required design parameters.

The above-described degrees of freedom, owned by the above-described robot apparatus 60, are actually mounted using an actuator. In view of a demand for eliminating excess swollenness in appearance to approximate the natural shape of the human being, and for enabling posture control of an unstable structure resulting from walking on two legs, the actuator is desirably small-sized and lightweight. It is more preferred for the actuator to be designed and constructed as a small-sized AC servo actuator of the direct gear coupling type in which a servo control system is arranged as one chip and mounted in a motor unit.

Figure 9:
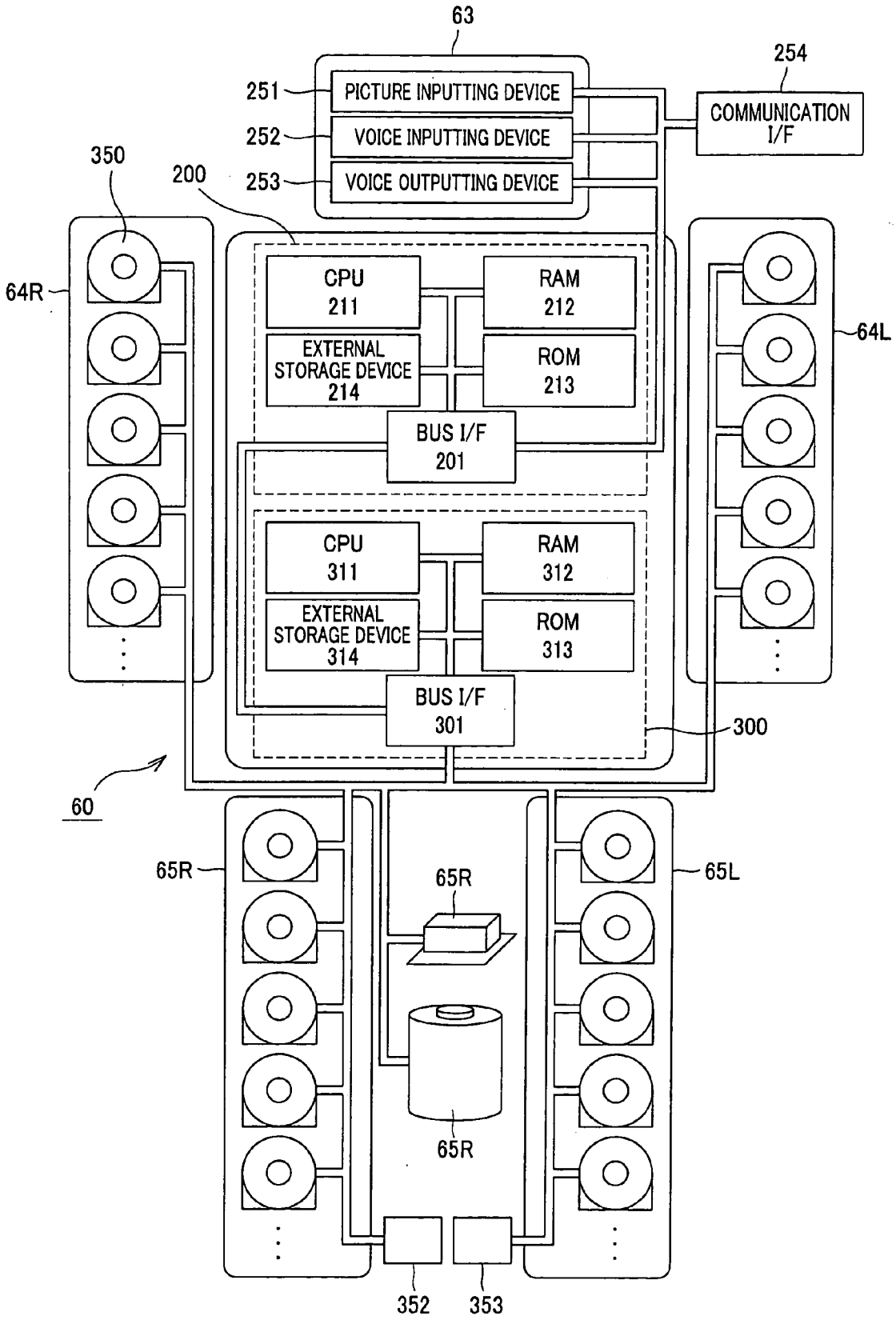
FIG. 9 is a block diagram showing the system structure of the robot apparatus.

FIG. 9 schematically shows a control system structure of the robot apparatus 60. Referring to FIG. 9, the control system is made up by a thinking control module 200, taking charge of emotional judgment or feeling expression, in response dynamically to a user input, and a movement control module 300 controlling the concerted movement of the entire body of the robot apparatus 60, such as driving of an actuator 350.

The thinking control module 200 is an independently driven information processing apparatus, which is made up by a CPU (central processing unit) 211, carrying out calculations in connection with emotional judgment or feeling expression, a RAM (random access memory) 212, a ROM (read-only memory) 213, and an external storage device (e.g. a hard disc drive) 214, and which is capable of performing self-contained processing within a module.

This thinking control module 200 decides on the current feeling or will of the robot apparatus, in accordance with the stimuli from outside, such as picture data entered from a picture inputting device 251 or voice data entered from a voice inputting device 252. The picture inputting device 251 includes e.g. a plural number of CCD (charge coupled device) cameras, while the voice inputting device 252 includes a plural number of microphones.

The thinking control module 200 issues commands for the movement control module 300 in order to execute a sequence of movements of behavior, based on decisions, that is, the exercising of the four limbs, The movement control module 300 is an independently driven information processing apparatus, which is made up by a CPU (central processing unit) 311, controlling the concerted movement of the entire body of the robot apparatus 60, a RAM 312, a ROM 313, and an external storage device (e.g. a hard disc drive) 314, and which is capable of performing self-contained processing within a module. The external storage device 314 is able to store an action schedule, including a walking pattern, as calculated off-line, and a targeted ZMP trajectory. It is noted that the ZMP is a point on a floor surface where the moment by the force of reaction exerted from the floor during walking is equal to zero, while the ZMP trajectory is the trajectory along which moves the ZMP during the walking period of the robot apparatus 60. As for the concept of ZMP and application of ZMP for the criterion of verification of the degree of stability of a walking robot, reference is made to Miomir Vukobratovic, "LEGGED LOCOMOTION ROBOTS" and Ichiro KATO et al., "Walking Robot and Artificial Legs", published by NIKKAN KOGYO SHIMBUN-SHA.

To the movement control module 300, there are connected e.g. actuators 350 for realization of the degrees of freedom, distributed over the entire body of the robot apparatus 60, shown in FIG. 8, a posture sensor 351, for measuring the posture of tilt of a body trunk unit 62, floor touch confirming sensors 352, 353 for detecting the flight state or the stance state of the foot soles of the left and right feet, and a power source control device 354 for supervising a power source, such as a battery, over a bus interface (I/F) 301. The posture sensor 351 is formed e.g. by the combination of an acceleration sensor and a gyro sensor, while the floor touch confirming sensors 352, 353 are each formed by a proximity sensor or a micro-switch.

The thinking control module 200 and the movement control module 300 are formed on a common platform and are interconnected over bus interfaces 201, 301.

The movement control module 300 controls the concerted movement of the entire body, produced by the respective actuators 350, for realization of the behavior as commanded from the thinking control module 200. That is, the CPU 311 takes out, from an external storage device 314, the behavior pattern consistent with the behavior as commanded from the thinking control module 200, or internally generates the behavior pattern. The CPU 311 sets the foot/leg movements, ZMP trajectory, body trunk movement, upper limb movement, horizontal position and height of the waist part, in accordance with the designated movement pattern, while transmitting command values, for commanding the movements consistent with the setting contents, to the respective actuators.

The CPU 311 also detects the posture or tilt of the body trunk unit 62 of the robot apparatus 60, based on control signals of the posture sensor 351, while detecting, by output signals of the floor touch confirming sensors 352, 353, whether the leg units 65R/L are in the flight state or in the stance state, for adaptively controlling the concerted movement of the entire body of the robot apparatus 60.

The CPU 311 also controls the posture or movements of the robot apparatus 60 so that the ZMP position will be directed at all times to the center of the ZMP stabilized area.

The movement control module 300 is adapted for returning to which extent the behavior in keeping with the decision made by the thinking control module 200 has been realized, that is, the status of processing, to the thinking control module 200.

In this manner, the robot apparatus 60 is able to verify the own state and the surrounding state, based on the control program, to carry out the autonomous behavior.

In this robot apparatus 60, the program, inclusive of data, which has implemented the above-mentioned singing voice synthesizing function, resides e.g. in the ROM 213 of the thinking control module 200. In such case, the program for synthesizing the singing voice is run by the CPU 211 of the thinking control module 200.

By providing the robot apparatus with the above-mentioned singing voice synthesizing function, as described above, the capacity of expression of the robot apparatus in singing a song to the accompaniment, is newly acquired, with the result that the properties of the robot apparatus as an entertainment robot are enhanced to further the intimate relationship of the robot apparatus with the human being.

INDUSTRIAL APPLICABILITY

With the singing voice synthesizing method and apparatus, according to the present invention, in which performance data are analyzed as the music information of the pitch and length of the sounds and as the music information of the lyric, the singing voice is generated based on the analyzed music information, and in which the type of the singing voice is determined on the basis of the information on the type of the sound contained in the analyzed music information, it is possible to analyze given performance data to generate the singing voice information in accordance with the sound note information, which is based on the lyric or the pitch, length or velocity of the sounds, derived from the analysis, in order to generate the singing voice in accordance with the singing voice information. It is also possible to determine the type of the singing voice based on the information pertinent to the type of the sound contained in the analyzed musical information, so that it is possible to sing with the timbre and voice quality suitable for the music air of interest. Consequently, the singing voice may be reproduced without adding any special information in the formulation or representation of the music, so far represented by solely the sounds of the musical instruments, thus appreciably improving the musical expression.

The program according to the present invention allows a computer to execute the singing voice synthesizing function of the present invention. The recording medium according to the present invention has this program recorded thereon and is computer-readable.

With the program and the recording medium according to the present invention, in which performance data are analyzed as the music information of the pitch and length of the sounds and as the music information of the lyric, the singing voice is generated based on the analyzed music information, and in which the type of the singing voice is determined on the basis of the information on the type of the sound contained in the analyzed music information, the performance data may be analyzed, the singing voice information may be generated on the basis of the musical note information, which is based on the pitch, length and the velocity of the sound and the lyric, derived from the analyzed performance data, and the singing voice may be generated on the basis of the so generated singing voice information. Moreover, by deciding on the type of the singing voice, based on the information pertinent to the sound type contained in the analyzed musical information, a song can be sung with the timbre and the voice quality suited to the target musical air.

The robot apparatus according to the present invention is able to achieve the singing voice synthesizing function according to the present invention. That is, with the autonomous robot apparatus, performing movements based on the input information, supplied thereto, according to the present invention, in which performance data are analyzed as the music information of the pitch and length of the sounds and as the music information of the lyric, the singing voice is generated based on the analyzed music information, and in which the type of the singing voice is determined on the basis of the information on the type of the sound contained in the analyzed music information, the performance data may be analyzed, the singing voice information may be generated on the basis of the musical note information, which is based on the pitch, length and the velocity of the sound and the lyric, derived from the analyzed performance data, and the singing voice may be generated on the basis of the so generated singing voice information. Moreover, by deciding on the type of the singing voice, based on the information pertinent to the sound type contained in the analyzed musical information, a song can be sung with the timbre and the voice quality suited to the target musical piece. The result is that the ability of expressions of the robot apparatus may be improved and the properties of the robot apparatus as an entertainment robot are enhanced to further the intimate relationship of the robot apparatus with the human being.

The invention claimed is:

1. A method for synthesizing a singing voice comprising:

an analyzing step of analyzing performance data as musical information of pitch, length of sound, and lyrics; and a singing voice generating step of generating the singing voice based on musical information analyzed;

said singing voice generating step determined by a type of said singing voice based on information on the type of sound included in the musical information analyzed.

2. The method for synthesizing the singing voice according to claim 1 wherein said performance data is performance data of a MIDI file.

3. The method for synthesizing the singing voice according to claim 2 wherein said singing voice generating step decides on the type of the singing voice based on the name of a musical instrument or name of a track/name of a sequence contained in a track in the performance data of said MIDI file.

4. The method for synthesizing the singing voice according to claim 2 wherein said singing voice generating step allocates time as from a time of a note-on until a time of a note-off of each sound of the singing voice as one sound of the singing voice, said time of the note-on being the timing reference for a beginning of each sound of the singing voice.

5. The method for synthesizing the singing voice according to claim 4 wherein, with the time of the note-on in said performance data of said MIDI file being the timing reference for the beginning of each sound of the singing voice, said singing voice generating step discontinuing a first sound of said singing voice in case there is a note-on of a second sound before the note-off of said first note as a note superposed on said first note, even before the note-off of said first sound, said singing voice generating step causing enunciation of said second sound of the singing voice at a time of the note-on of said second note.

6. The method for synthesizing the singing voice according to claim 5 wherein, if there is no superposition between said first and second notes in said performance data of said MIDI file, said singing voice generating step attenuates the sound volume of said first sound to render the break point from the second sound of the singing voice clear, said singing voice generating step not attenuating the sound volume in case there is superposition between said first and second notes and piecing said first and second notes together to express a slur in musical air.

7. The method for synthesizing the singing voice according to claim 5 wherein, if there is no superposition between said first and second notes, but there is only a sound break interval between said first and second notes shorter than a pre-specified time, said singing voice generating step shifts the timing of the end of said first sound to the timing of the beginning of said second sound to piece the first and second notes together.

8. The method for synthesizing the singing voice according to claim 4 wherein, if there are plural notes having the same note-on timing in the performance data of said MIDI file, said singing voice generating step selects the note of the highest pitch as the sound of a song.

9. The method for synthesizing the singing voice according to claim 4 wherein, if there are plural notes having the same note-on timing in the performance data of said MIDI file, said singing voice generating step selects the note of the lowest pitch as the sound of a song.

10. The method for synthesizing the singing voice according to claim 4 wherein, if there are plural notes having the same note-on timing in the performance data of said MIDI file, said singing voice generating step selects a note of the maximum sound volume as the sound of a song.

11. The method for synthesizing the singing voice according to claim 4 wherein, if there are plural notes having the same note-on timing in the performance data of said MIDI file, said singing voice generating step treats the notes as separate voice parts and imparts the same lyrics to the voice parts to generate a singing voice including different values of pitch.

12. The method for synthesizing the singing voice according to claim 4 wherein, if the time length from the note-on until note-off is shorter than a prescribed value, said singing voice generating step does not treat a note as the subject of singing.

13. The method for synthesizing the singing voice according to claim 4 wherein the time length as from the note-on until note-off is expanded a preset ratio to generate the singing voice.

14. The method for synthesizing the singing voice according to claim 13 wherein data of said preset ratio used for changing the time as from the note-on until note-off is provided in a form associated with the names of the musical instruments.

15. The method for synthesizing the singing voice according to claim 4 wherein said singing voice generating step adds a preset time to the time from the note-on until note-off in said performance data of said MIDI file to generate the singing voice.

16. The method for synthesizing the singing voice according to claim 15 wherein preset data for addition for changing the time from the note-on until note-off is provided in a form associated with the names of the musical instruments.

17. The method for synthesizing the singing voice according to claim 4 wherein said singing voice generating step changes the time from the note-on until note-off, and wherein data for changing said time is set by an operator.

18. The method for synthesizing the singing voice according to claim 2 wherein said singing voice generating step sets the type of the singing voice from one name of musical instrument to the next.

19. The method for synthesizing the singing voice according to claim 2 wherein, if the designation of a musical instrument is changed by a patch in the performance data of said MIDI file, said singing voice generating step changes the type of the singing voice even in a same track.

20. An apparatus for synthesizing the singing voice comprising:

analyzing means for analyzing performance data as musical information of pitch and length of sound, and lyrics; and singing voice generating means for generating the singing voice based on musical information analyzed;

said singing voice generating means deciding a type of said singing voice based on information on the type of sound included in the musical information analyzed.

21. The apparatus for synthesizing the singing voice according to claim 20 wherein said performance data is performance data of a MIDI file.

22. The apparatus for synthesizing the singing voice according to claim 21 wherein said singing voice generating means decides on the type of the singing voice based on the name of a musical instrument or a name of a track/name of a sequence contained in a track in the performance data of said MIDI file.

23. The apparatus for synthesizing the singing voice according to claim 21 wherein said singing voice generating means allocates time as from a time of a note-on until a time of a note-off of each sound of the singing voice as one sound of the singing voice, said time of the note-on in the performance data of the MIDI file being the timing reference for a beginning of each sound of the singing voice.

24. A computer-readable recording medium having recorded thereon a program for having a computer execute a method of synthesizing a singing voice, said method comprising:

analyzing performance data as musical information of pitch, length of sound, and lyrics; and generating a singing voice based on musical information analyzed;

said generating a singing voice is decided on a type of said singing voice based on information on a type of sound included in the musical information analyzed.

25. The method according to claim 24 wherein said performance data is performance data of a MIDI file.

26. An autonomous robot apparatus for synthesizing a singing voice, comprising:

analyzing means for analyzing performance data as musical information of pitch, length of sound, and lyrics; and singing voice generating means for generating a singing voice based on musical information analyzed;

said singing voice generating means decides a type of said singing voice based on information on a type of sound included in the musical information analyzed.

27. The robot apparatus for synthesizing the singing voice according to claim 26 wherein said performance data is performance data of a MIDI file.

28. An apparatus for synthesizing a singing voice comprising:

An analyzing circuit for analyzing performance data as musical information of pitch, length of sound, and lyrics; and a singing voice generating circuit for generating the singing voice based on musical information analyzed;

said singing voice generating circuit determines a type of said singing voice based on information on the type of sound included in the musical information analyzed.

* * * * *